US012649607B2

(12) United States Patent
Lee et al.

(10) Patent No.: US 12,649,607 B2
(45) Date of Patent: Jun. 9, 2026

(54) TRAY

(71) Applicant: Samsung Display Co., Ltd., Yongin-Si (KR)

(72) Inventors: Kyung Jo Lee, Yongin-si (KR); Young Ji Kim, Yongin-si (KR); Jung Gil Oh, Yongin-si (KR); Nam Pyo Hong, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 18/916,704

(22) Filed: Oct. 16, 2024

(65) Prior Publication Data

US 2025/0304308 A1 Oct. 2, 2025

(30) Foreign Application Priority Data

Apr. 2, 2024 (KR) ..... 10-2024-0044886

(51) Int. Cl.
*B65D 85/48* (2006.01)
*B65D 1/36* (2006.01)

(52) U.S. Cl.
CPC ..... *B65D 1/36* (2013.01); *B65D 85/48* (2013.01)

(58) Field of Classification Search
CPC ..... B65D 85/48; B65D 1/36; B65D 25/107; B65D 25/103; B65D 71/70; B65D 2585/6837; B65D 81/1075; B65D 5/509; H01L 21/67369
USPC ..... 206/448, 454, 591, 593; 211/41.14, 41
See application file for complete search history.

(56) References Cited

U.S. PATENT DOCUMENTS 6,799,677 B2 * 10/2004 Marsilio ..... G11B 33/0427
7,066,327 B2 * 6/2006 Baublitz ..... B65D 75/22 206/349

FOREIGN PATENT DOCUMENTS

KR 10-1979903 B1 5/2019
TW M534734 U * 1/2017 ..... B65D 81/113

OTHER PUBLICATIONS

Lin, TW-M534734-U, translation (Year: 2016).*

* cited by examiner

*Primary Examiner* — Mollie Impink
(74) *Attorney, Agent, or Firm* — Innovation Counsel LLP

(57) ABSTRACT

The present disclosure relates to a tray. According to an embodiment, a tray includes: a tray bottom portion including a base surface, a guide protruding from the base surface, and an avoidance groove recessed from the base surface; and a tray sidewall portion disposed on at least one edge of the tray bottom portion. At least a partial area of the avoidance groove is disposed between the guide and the base surface.

18 Claims, 18 Drawing Sheets

TRAY

CROSS-REFERENCE TO RELATED APPLICATION

This application claims priority from Korean Patent Application No. 10-2024-0044886 filed on Apr. 2, 2024 in the Korean Intellectual Property Office, and all the benefits accruing therefrom under 35 U.S.C. 119, the contents of which in its entirety are herein incorporated by reference.

BACKGROUND

Technical Field

The present disclosure relates to a tray.

Description of the Related Art

The demand for and applications of display devices have increased and diversified as our information-based society has developed. For example, display devices are currently used in many electronic devices such as smartphones, digital cameras, laptop computers, navigation devices, and smart televisions. Various types of display devices such as liquid crystal displays (LCDs) and organic light emitting displays (OLEDs) have been developed. An organic light emitting display, for example, includes organic light emitting elements, and recombination of electrons and holes in each organic light emitting element generates light that forms part, e.g., a pixel, of an image. An organic light emitting display also includes transistors providing driving currents to the organic light emitting elements.

Display panels such as organic light emitting display panels have needed to become smaller and thinner for use in small or miniature electronic devices. Such small or miniature display panels may be more vulnerable to damage. Accordingly, systems and methods are needed to protect display panels during processes such as loading and transporting display panels or display devices generally.

A display device may be loaded, transported, and stored in a tray while going through various manufacturing processes, and when manufacturing processes are finished, the finished display device may be loaded, packaged, and transported in the tray. In some cases, each display device may be loaded and transported in its own tray, but multiple display devices may need to be loaded, transported, or stored at a time in order to improve process efficiency and loading efficiency. Accordingly, trays may be stacked, and the display devices may be stored and transported in a stack of trays.

A loading target element such as a display panel may be vertically accommodated in a tray to efficiently use a tray loading space. When the loading target element is vertically accommodated in the tray as described above, an edge surface of the loading target element may be in direct contact with the bottom of the tray (i.e., the loading target element has a line contact with the tray). The weight or load of the loading target element is concentrated on the edge surface of the loading target element in contact with the bottom of the tray, and thus, the edge surface of the loading target element may rub against the tray. That is, the tray may damage the loading target element.

SUMMARY

Aspects of the present disclosure provide a tray capable of preventing rubbing of a loading target element. The tray may prevent interference between the bottom of the tray and the loading target element, specifically, by suppressing line contact between the tray and the loading target element and guiding the loading target element so that the loading target element comes into surface contact with the tray.

According to an embodiment, a tray includes a tray bottom portion and a tray sidewall portion. The tray bottom may include a base surface, a guide protruding from the base surface, and an avoidance groove recessed from the base surface. The tray sidewall portion is disposed on at least one edge of the tray bottom portion. At least a partial area of the avoidance groove may be disposed between the guide and the base surface.

In an embodiment, a sidewall of the avoidance groove is aligned with a side surface of the guide adjacent to the avoidance groove.

In an embodiment, the avoidance groove is in direct contact with the guide and the base surface.

In an embodiment, the tray bottom portion is configured so that a loading target element is loaded on the base surface of the tray bottom portion, and the guide is configured so that a side surface of the guide supports the loading target element loaded on the tray bottom portion.

In an embodiment, a width of the avoidance groove is greater than a width of the loading target element.

In an embodiment, the guide includes: a guide side surface in contact with the loading target element in a direction perpendicular to the base surface to support the loading target element; and a guide inclined surface connected to the guide side surface and positioned between the guide side surface and the avoidance groove. A height from the avoidance groove to the base surface is greater than the height from the avoidance groove to the guide inclined surface.

In an embodiment, the tray sidewall portion includes a coupling portion coupling an edge area of the loading target element to the tray sidewall portion.

In an embodiment, the coupling portion includes: a plurality of coupling protrusions positioned on the tray sidewall portion and disposed at intervals; and a coupling groove formed between the plurality of coupling protrusions and accommodating the edge area of the loading target element.

In an embodiment, a width of the coupling groove is greater than a width of the edge area of the loading target element accommodated in the coupling groove.

In an embodiment, guides are arranged at intervals along a contact path on which the loading target element is in contact with the base surface.

In an embodiment, a connection line connecting the plurality of guides to each other is curved.

In an embodiment, a connection line connecting the plurality of guides to each other is straight.

In an embodiment, the guide has a protrusion with a triangular, quadrangular, circular, or elliptical cross-sectional shape.

In an embodiment, the avoidance groove has a closed loop shape extending along a perimeter of the guide.

In an embodiment, the avoidance groove is discontinuous along a perimeter of the guide.

In an embodiment, a plurality of avoidance grooves are provided and respectively correspond to the plurality of guides, and the plurality of avoidance grooves continuously communicate with each other along the contact path.

In an embodiment, the tray further includes a bottom tray and a tray cover. The bottom tray supports the tray bottom portion and the tray sidewall portion below the tray bottom portion and the tray sidewall portion, and the tray cover covers the tray bottom portion and the tray sidewall portion above the tray bottom portion and the tray sidewall portion.

In an embodiment, the loading target element is a curved, bent, or flat display device.

According to an embodiment, a tray includes a tray body accommodating a plurality of loading target elements in a stand-up direction. The tray body includes a base surface that contacts lower edges of the loading target element. A plurality of guides or support blocks protrude from the base surface and support the loading target elements in the stand-up direction, and contact avoidance grooves are recessed from the base surface in areas adjacent to the support blocks, and a connection line connecting side edge areas of the loading target element accommodated in the tray body is a curved line.

In an embodiment, a width of the contact avoidance groove is greater than a width of each of the loading target elements.

With a tray according to an exemplary embodiment, when a loading target element is vertically loaded in the tray, rubbing due to interference of a guide of the tray may be prevented, such that damage to the loading target element due to the tray, specifically, interference of the tray may be prevented.

The above and other aspects of the present disclosure will become more apparent to one of ordinary skill in the art to which the present disclosure pertains by referencing the detailed description of the present disclosure given below. However, aspects of the present disclosure are not restricted to those set forth herein.

DETAILED DESCRIPTION

Figure 1:
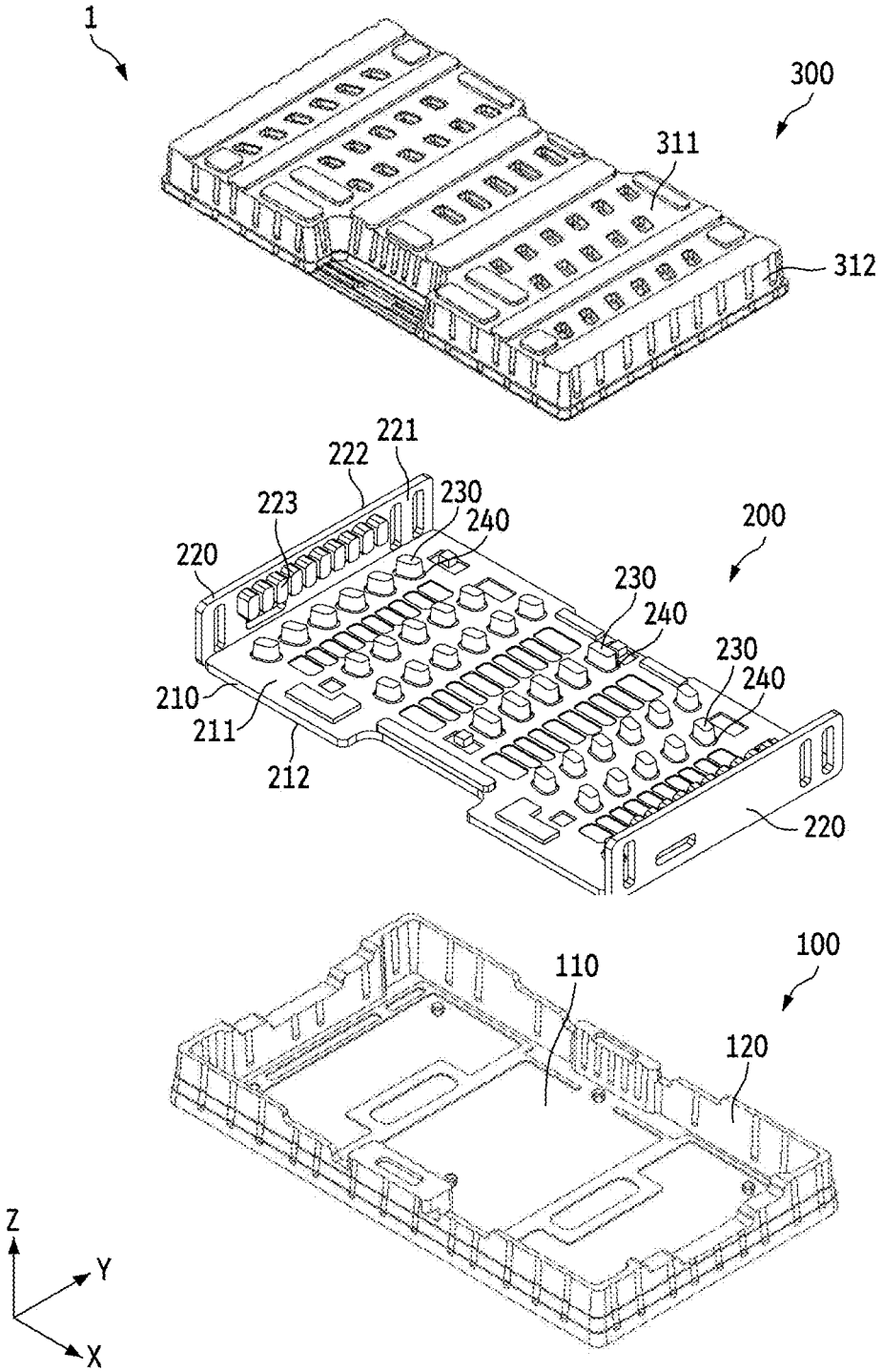
FIG. 1 is an exploded perspective view of a tray according to an exemplary embodiment.

The present disclosure describes example embodiments more fully hereinafter with reference to the accompanying drawings. Embodiments in accordance with this disclosure may, however, take different forms, and this disclosure should not be construed as being limited to the specific embodiments set forth herein. Rather, these embodiments are provided so that this disclosure will be thorough and complete and will fully convey the scope of the appended claims.

The drawings repeat use of the same reference numbers to identify similar or identical elements. The thicknesses and dimensions of elements may be altered, e.g., exaggerated, in the drawings for clarity of illustration or description.

A layer or other element referred to herein as being "on" another layer, substrate, or other object may be directly on the other layer, substrate, or object, or intervening layers or objects may also be present.

Although the terms "first", "second", etc. may be used herein to describe various elements, these elements should not be limited by these terms. These terms may be used to distinguish one element from another element. Thus, a first element discussed below may be termed a second element without departing from teachings of one or more embodiments. The description of an element as a "first" element may not require or imply the presence of a second element or other elements. The terms "first", "second", etc. may also be used herein to differentiate different categories or sets of elements. For conciseness, the terms "first", "second", etc. may represent "first-category (or first-set)", "second-category (or second-set)", etc., respectively.

Features of various embodiments of the present disclosure may be combined partially or totally. As will be clearly appreciated by those skilled in the art, various interactions and operations are possible. Various embodiments can be practiced individually or in combination.

Hereinafter, exemplary embodiments of the present disclosure will be described with reference to the accompanying drawings.

Figure 2:
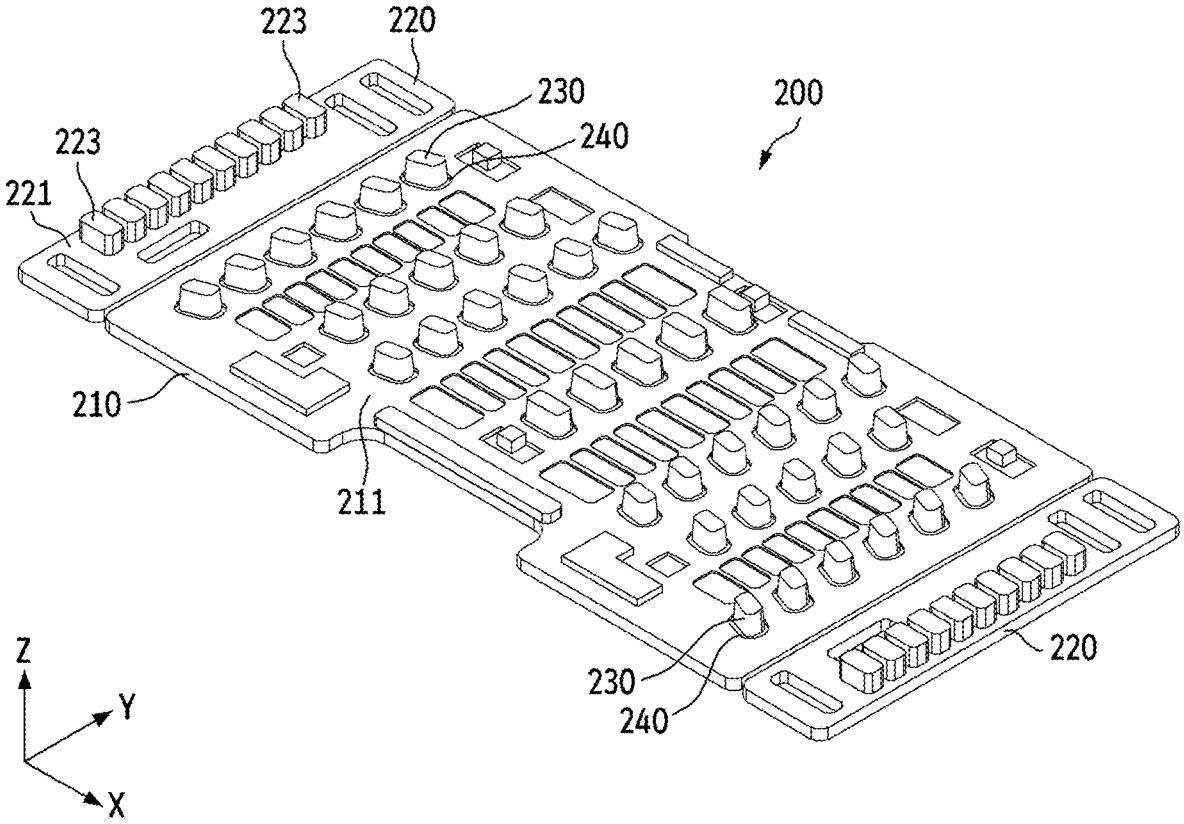
FIG. 2 is a perspective view of an embodiment of the internal tray that is a component of the tray shown in FIG. 1.
Figure 3:
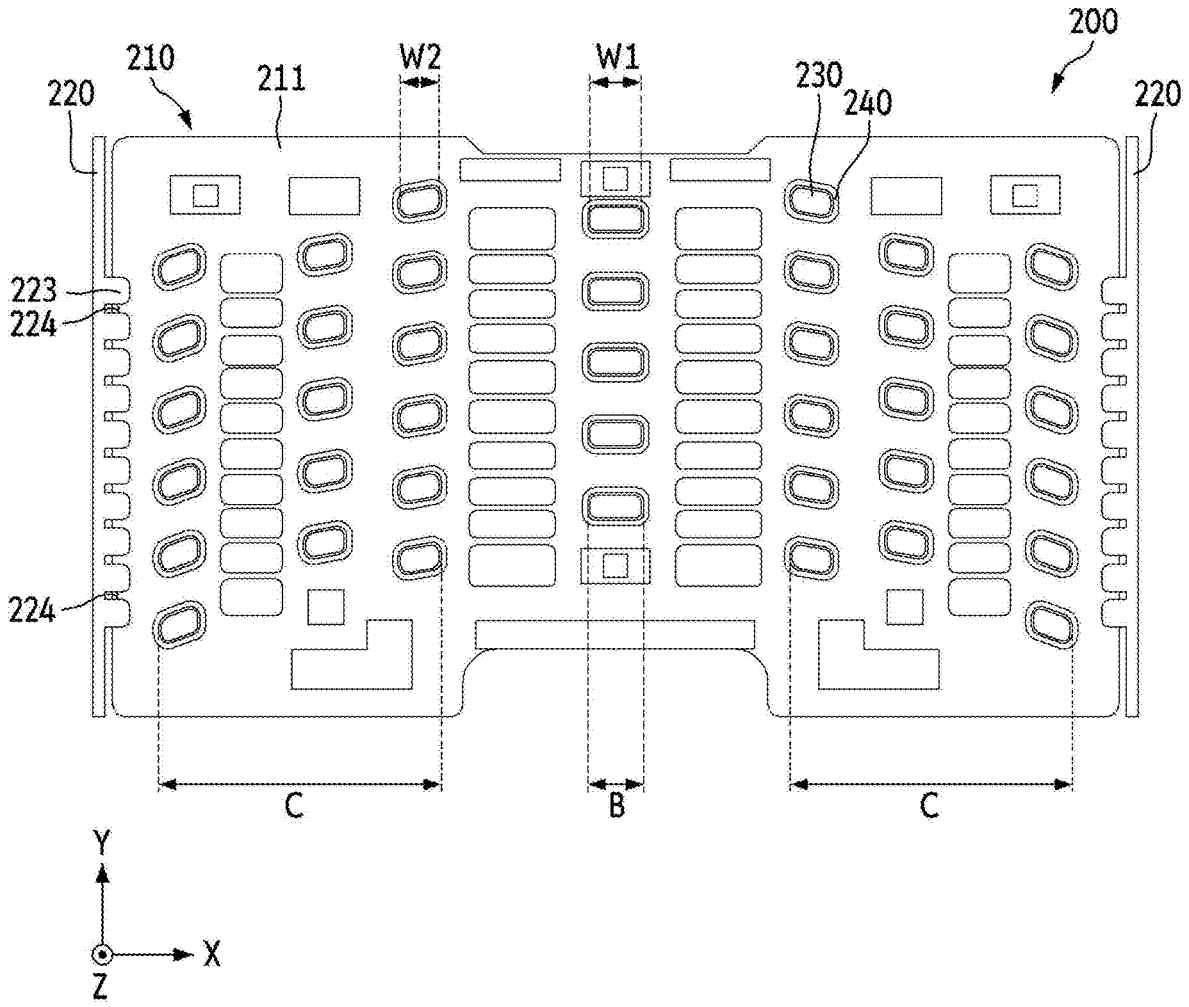
FIG. 3 is a plan view of the internal tray of FIG. 2.
Figure 4:
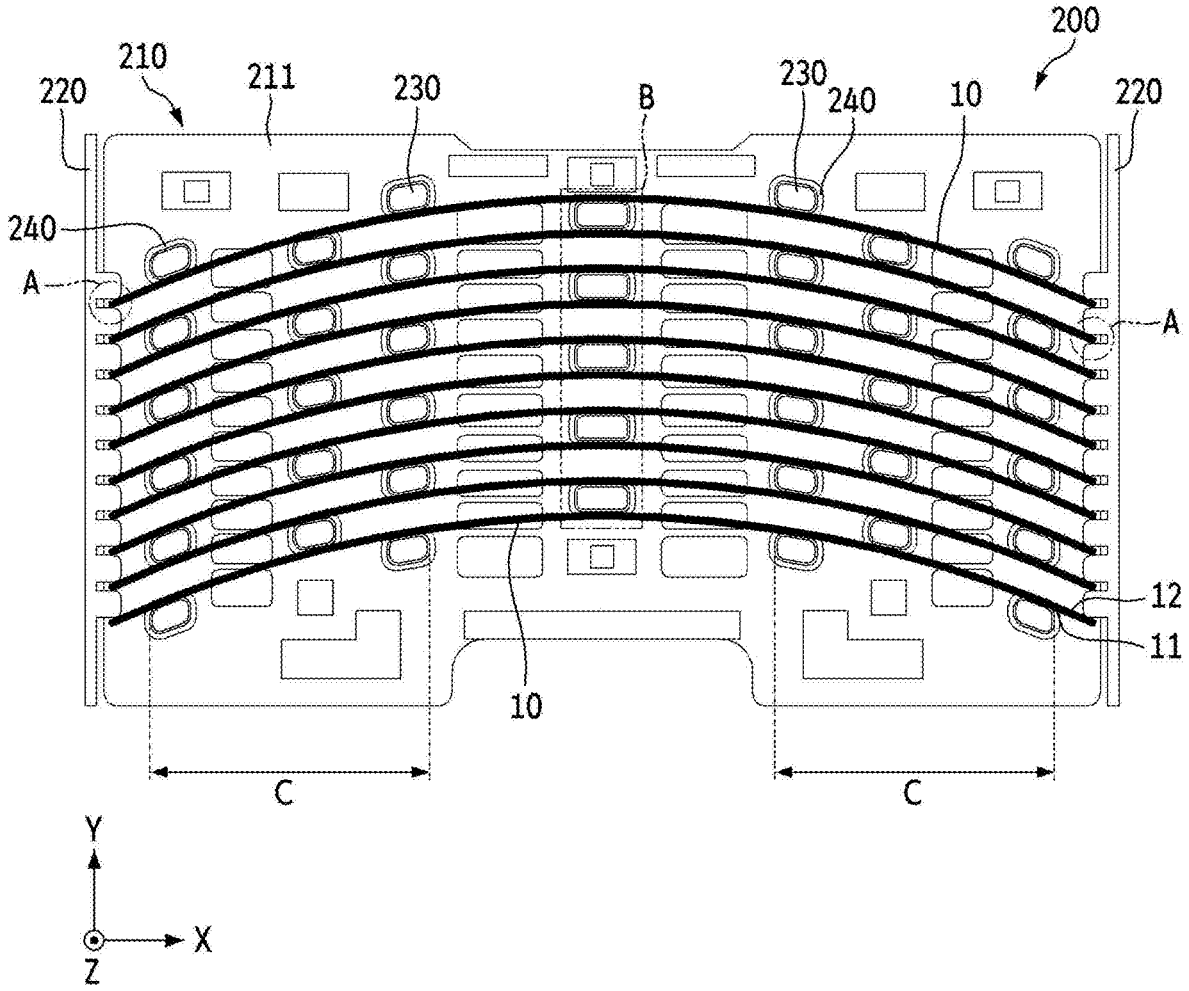
FIG. 4 is a plan view illustrating loading target elements in the internal tray of FIG. 3.
Figure 5:
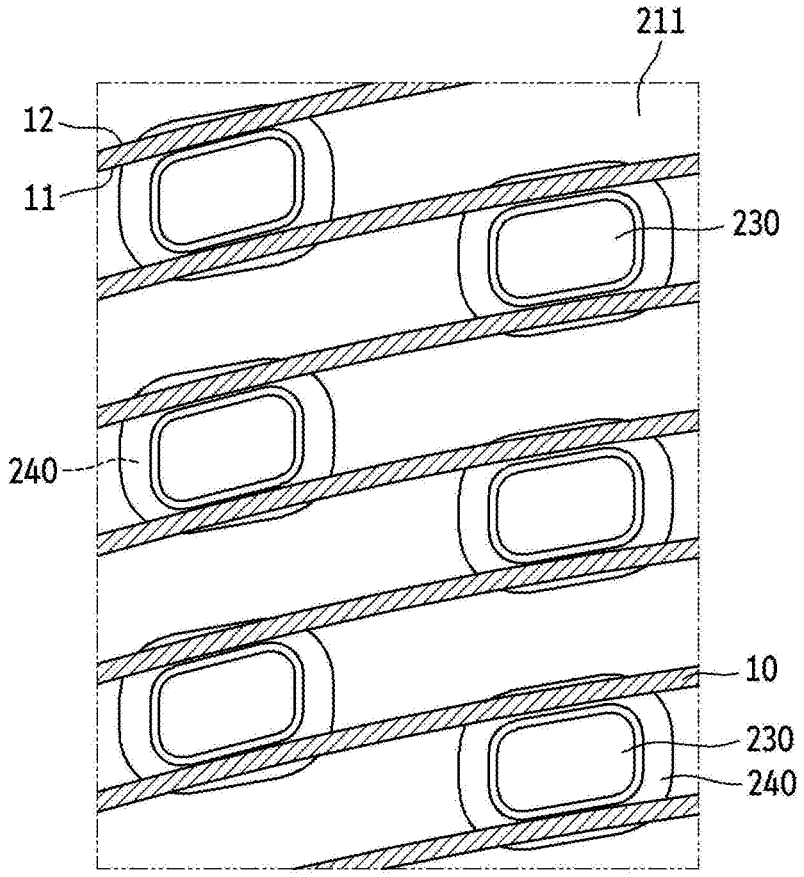
FIG. 5 is an enlarged plan view of a plurality of guides and avoidance grooves illustrated in FIG. 4.
Figure 6:
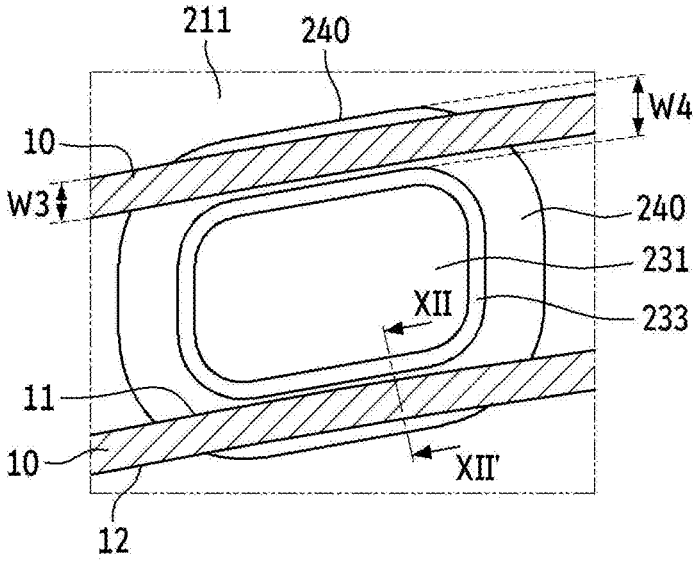
FIG. 6 is an enlarged plan view of a guide and an avoidance groove illustrated in FIG. 5.

FIG. 1 is an exploded perspective view of a tray according to an exemplary embodiment. FIG. 2 is a perspective view of an internal tray which may be an element of the tray shown in FIG. 1. FIG. 3 is a plan view of the internal tray of FIG. 2. FIG. 4 is a plan view illustrating loading target elements accommodated in the internal tray of FIG. 3. FIG. 5 is an enlarged view of a plurality of guides and avoidance grooves illustrated in FIG. 4, and FIG. 6 is an enlarged plan view of a guide and an avoidance groove illustrated in FIG. 5.

Referring to FIG. 1, a tray 1 may accommodate and store loading target elements 10 such as shown in FIG. 4. More particularly, the tray 1 may accommodate one loading target element 10 alone or accommodate a plurality of loading target elements 10, but the tray 1 is not limited thereto.

The loading target element 10 may be accommodated inside the tray 1, and the tray 1 may protect the loading target element 10 when the loading target element 10 is stored in the tray 1 and may prevent damage to the loading target element 10 due to the movement of the loading target element 10 when the tray 1 containing the loading target element 10 is transported.

The tray 1 may be made of various materials that may be chosen based on consideration of process convenience, manufacturing costs, and the like. For example, the tray 1 may include a polymer compound that may be injected to form elements of the tray 1. Here, the polymer compound may include one or more selected from polypropylene (PP), polyethylene terephthalate (PET), polyvinyl chloride (PVC), acrylonitrile butadiene styrene (ABS), and polystyrene (PS). The tray 1 may particularly be made of a plastic resin such as acrylonitrile butadiene styrene (ABS) copolymer or polystyrene (PS), embodiments but are not limited thereto.

Referring to FIG. 1, the tray 1 may include tray bodies 100 and 200 and a tray cover 300 for covering the tray bodies 100 and 200.

The tray bodies 100 and 200 may serve to accommodate the loading target element 10 with major surfaces of the loading target element 10 extending in a vertical direction, which is a Z direction. In particular, the tray body 200, sometimes referred to herein as the internal tray 200, may be shaped to form space for accommodating the loading target element 10. The tray body 100, sometimes referred to herein as the bottom tray 100, may support the internal tray 200.

The tray 1 may have a triple or three-part structure including the bottom tray 100, the internal tray 200, and the tray cover 300 as illustrated in FIG. 1. In a case where the tray 1 has the triple structure, the tray cover 300 may be removed when the loading target element 10, for example, an automobile module, is being loaded into the internal tray 200. The internal tray 200 may be decoupled from or coupled to, in the vertical direction, which is the Z direction, the bottom tray 100 to increase loading efficiency, and the internal tray 200 in which the loading target element 10 is vertically loaded as described above may be used as a transfer container. In addition, after the loading target element 10 is loaded, the loading target element 10 accommodated in the internal tray 200 may be protected from an external environment by closing an upper opening with the tray cover 300.

The tray 1 may have the triple structure as illustrated in FIG. 1, but is not limited thereto, and the tray bodies 100 and 200 do not require a double structure including the bottom tray 100 and the internal tray 200 be separable, and the bottom tray 100 and the internal tray 200 may be formed integrally with each other as one body. In this case, unlike FIG. 1 where the loading target element 10 may be accommodated in the internal tray 200 provided separately from the bottom tray 100, guides 230 may be positioned on a bottom surface 110 of the bottom tray 100 and the loading target element 10 may be vertically accommodated on the guides 230 of the bottom tray 100. In this case, the tray cover 300 may be positioned above the bottom tray 100 or may not be disposed above the bottom tray 100.

The bottom tray 100 may define an internal space, sometimes referred to herein as the accommodation space, in which at least a portion of the internal tray 200 fits and couples to the bottom tray 100, and the bottom tray 100 may serve to protect the internal tray 200 from an external shock.

The accommodation space in which the internal tray 200 may be accommodated, may include the bottom surface 110 of the bottom tray 100, and the bottom surface 110 may face a lower surface 212 of a tray bottom portion 210 of the internal tray 200 when the internal tray 200 is in the accommodation space. The bottom tray 100 may also have side surfaces 120 extending from the bottom surface 110 in a stand-up direction, which is the Z direction, and the side surfaces 120 of the bottom tray 100 may support tray sidewall portions 220 of the internal tray 200 when the internal tray 200 is in the accommodation space.

The bottom tray 100 may have a hexahedral shape with an upper opening having a rectangular shape, but the bottom tray 100 is not limited thereto and may, for example, have various polyhedral shapes. In addition, the bottom tray 100 may have a rectangular shape in plan view, but is not limited thereto, and may have various shapes depending on the shape of the loading target element 10 or the internal tray 200. The bottom tray 100 may have various shapes such as a square shape, a circular shape, or an elliptical shape.

The tray cover 300 may fit on top of the tray bodies 100 and 200, specifically, the internal tray 200, and the tray cover 300 may serve to protect the loading target element 10 accommodated in the internal tray 200 from the external environment.

The tray cover 300 may cover an upper portion of the loading target element 10 accommodated in the internal tray 200 and may include a cover upper surface 311 and cover side surfaces. The cover upper surface may face a base surface 211 (which is described further below) of the internal tray 200, and the cover side surfaces 312 may be positioned along at least a portion of the perimeter of the cover upper surface 311. When a size of the tray cover 300 is greater than that of the bottom tray 100, the cover side surfaces 312 may cover the side surfaces 120 of the bottom tray 100, and when the size of the tray cover 300 is the same as that of the bottom tray 100, the cover side surfaces 312 may be seated on the side surfaces 120 of the bottom tray 100, but the present disclosure is not limited thereto.

The tray cover 300 may have a hexahedral shape with a lower opening (in the Z direction) that may be sized to cover upper openings of the tray bodies 100 and 200. However, the present disclosure is not limited thereto, and the tray cover 300 may have various polyhedral or other shapes as long as the tray cover 300 may cover the upper openings of the tray bodies 100 and 200. For example, the tray cover 300 may have a plate shape rather than the polyhedral shape and cover only the upper openings of the tray bodies 100 and 200.

The internal tray 200 may be positioned between the tray cover 300 and the bottom tray 100 in the Z direction and may be coupled to the bottom tray 100. The internal tray 200, when coupled to the bottom tray 100 or otherwise, may serve to accommodate the loading target element 10. In addition, the loading target element 10 accommodated in the internal tray 200 as described above may be protected by the tray cover 300 positioned above the internal tray 200.

FIG. 2 shows a perspective view of the internal tray 200 with tray sidewall portions 220 are unfolded and predominantly extending in the same plane (e.g., the X-Y plane) as the bottom portion 210 of the internal tray 200, and FIG. 3 shows a plan view of the internal tray 200 when sidewall portions 220 are folded to be perpendicular to the bottom portion of the internal tray 200. Referring to FIGS. 2 and 3, the internal tray 200 may include the tray bottom portion 210 on which the loading target element 10 is loaded and a pair of tray sidewall portions 220 disposed to stand up in the Z direction with respect to the tray bottom portion 210 as shown in the embodiment of FIG. 3.

In an embodiment, the tray bottom portion 210 may be generally rectangular as shown in FIGS. 2 and 3, and the pair of tray sidewall portions 220 may be respectively positioned on opposite edge of the rectangular area of the tray bottom portion 210, the edge areas being separated from each other in an X direction. However, the tray sidewall portions 220 are not limited thereto. For example, a pair of tray sidewall portions 220 may be respectively positioned on respective edge areas of the tray bottom portion 210 separated in a Y direction, or four tray sidewall portions 220 may be respectively positioned along the edges of the rectangular area of the tray bottom portion 210.

Each tray sidewall portion 220 may include an inner side surface 221 connected to a base surface 211 which is described further below) of the tray bottom portion 210 and an outer side surface 222 opposite to the inner side surface 221.

The internal tray 200 may be accommodated inside the bottom tray 100, and when the internal tray 200 is in the bottom tray 100, that is, in a state where the tray sidewall portions 220 are accommodated inside the bottom tray 100, the outer side surfaces 222 of the tray sidewall portions 220 may be in contact with and be supported by the side surfaces 120 of the bottom tray 100, but embodiments are not limited thereto, and the tray sidewall portions 220 may instead be spaced apart from the side surfaces 120 of the bottom tray 100.

The tray sidewall portion 220 may be foldably coupled to the tray bottom portion 210. For example, each tray sidewall portion 220 may be coupled to the tray bottom portion 210 by a hinge (not illustrated), and the hinge may allow the tray sidewall portion 220 to stand up in the Z direction with respect to the tray bottom portion 210. The hinge may have a shaft positioned on the same plane as the tray bottom portion 210 (e.g., the X-Y plane as illustrated in FIG. 2.) With hinges, when the internal tray 200 is accommodated inside the bottom tray 100, each tray sidewall portion 220 may rotate about the hinge shaft from the configuration of FIG. 2 into the stand-up direction and then be parallel with the side surface 120 of the bottom tray 100 as shown in FIG. 3. When the internal tray 200 is not accommodated in the bottom tray 100, the tray each sidewall portion 220 may be positioned in the same plane as the tray bottom portion 210, as illustrated in FIG. 2. However, the present disclosure is not limited thereto. For example, the tray sidewall portions 220 may be fixed to the tray bottom portion 210 in the stand-up direction without hinges, or the tray sidewall portion 220 and the tray bottom portion 210 may be formed integrally with each other in a shape similar to the shape of the bottom tray 100 rather than being separate frames coupled to each other by hinges.

Referring to FIGS. 3 and 4, the tray sidewall portions 220 may further include coupling portions 223 and 224 that couple to edge areas A of the loading target elements 10 when the loading target elements 10 are loaded on the tray bottom portion 210. The coupling portions 223 and 224 may include a plurality of coupling protrusions 223 positioned on the tray sidewall portion 220 and disposed at intervals and include coupling grooves 224 formed between the coupling protrusions 223 and accommodating the edge areas A of the loading target elements 10.

The coupling protrusions 223 may be disposed at regular intervals on the tray sidewall portion 220, and an interval between the coupling protrusions 223 may be smaller than an interval between guides 230, which are described further below.

Each coupling protrusion 223 may protrude in the X direction, but the coupling protrusions 223 are not limited thereto. In an embodiment, each coupling protrusion 223 may have a hexahedral shape including a quadrangular surface, but the coupling protrusions 223 are not limited thereto. For example, a cross-section of any coupling protrusion 223 may have various shapes such as a circular shape, a square shape, a rectangular shape, an elliptical shape, or a triangular shape.

The coupling grooves 224 may correspond to the intervals between the coupling protrusions 223, and a width of each coupling groove 224 may be greater than a thickness of the edge area A of the loading target element 10, specifically, a width W3 of the loading target element 10, which is described further below with reference to FIG. 6. However, the present disclosure is not limited thereto, and the width of each coupling groove 224 may also be the same as the thickness of the edge area A of the loading target element 10. Accordingly, the edge areas A of the loading target elements 10 may be coupled to the tray sidewall portion 220 while respectively being accommodated in the coupling grooves 224. The loading target element 10 may specifically be loaded in the internal tray 200 in the vertical direction, which is the Z direction.

The tray bottom portion 210 of the internal tray 200 may include the base surface 211 on which the loading target element 10 is seated, the lower surface 212 of the tray bottom portion 210 opposite to the base surface 211, the plurality of guides 230 positioned on the base surface 211, and avoidance grooves 240.

The lower surface 212 of the tray bottom portion 210 is a surface positioned opposite to the base surface 211 and may face the bottom surface 110 of the bottom tray 100 when the internal tray 200 is accommodated in the bottom tray 100. When a size of the lower surface 212 of the tray bottom portion 210 is smaller than the size of the bottom tray 100, the lower surface 212 of the tray bottom portion 210 may be accommodated inside the bottom tray 100 and be in contact with the bottom surface 110 of the bottom tray 100, but embodiments are not limited thereto. When the size of the lower surface 212 of the tray bottom portion 210 is the same as the size of the bottom tray 100, the lower surface 212 of the tray bottom portion 210 may be positioned above the bottom tray 100 at a position where the lower surface 212 of the tray bottom portion 210 is spaced apart from the bottom surface 110 of the bottom tray 100.

The base surface 211 of the tray bottom portion 210 in plan view may have a rectangular shape like the bottom surface 110 of the bottom tray 100 in plan view, but the shape of the base surface 211 is not limited thereto. The base surface 211 may have various shapes such as a square shape, a circular shape, and an elliptical shape corresponding to a shape of the bottom tray 100 depending on a type of the loading target element 10.

The base surface 211 of the tray bottom portion 210 may have a flat plate shape, which may include a surface in contact with the loading target element 10 when the loading target element 10 is loaded in the vertical direction.

The base surface 211 of the tray bottom portion 210 may include the plurality of guides 230 and the plurality of avoidance grooves 240. The guides 230 define an accommodation interval for accommodating the loading target element 10 and support a position of each loading target element 10 in the vertical direction, which is the Z direction. The avoidance grooves 240 are positioned around the respective guides 230.

The guides 230 may serve to support the loading target elements 10 so that the loading target elements 10 may be loaded in the vertical direction within the internal tray 200, specifically, so that the plurality of loading target elements 10 may be accommodated to stand up.

Each guide 230 may protrude upward from the base surface 211, and the plurality of guides 230 may be arranged along accommodation paths of the loading target elements 10, for example, contact paths P, which are described further below with reference to FIG. 7.

Referring to FIGS. 3 and 4, the plurality of guides 230 may be arranged in a first column B and second columns C with each columns B and C extending along the Y direction. The guides 230 in the first column B support central portions of the loading target elements 10. The second columns C may be separated from each other along the Y direction, and the first column B may be between sets of the second columns C of the guides 230 supporting end areas of the loading target elements 10 with the first column B interposed therebetween.

A width W1 of each guide 230 positioned in the first column B may be greater than a width W2 of each guide 230 positioned in the second columns C. However, the present disclosure is not limited thereto, and the width W1 of the guides 230 in the first column B may be the same as or smaller than the width W2 of the guides 230 in the second columns C.

Each avoidance groove 240 may be recessed from the base surface 211, may be positioned along a circumference or perimeter of the associated guide 230, and may prevent a portion of the loading target element 10 from contacting the base surface 211 and a guide inclined or transition surface 233 of the guide 230, so that a portion of the loading target element 10 in contact with the base surface 211 is not in contact with the guide inclined surface 233. Specifically, the avoidance groove 240 may be provided in the form of a groove avoiding a contact state so that the loading target element 10 may be in surface contact with the tray rather than being in line contact with the tray.

Referring to FIGS. 1 and 4, the loading target element 10 may be loaded and stored in the tray 1 of FIG. 1 or transported in a state where the loading target element 10 is accommodated in the tray 1. Examples of the loading target element 10 may include various display devices providing display screens, such as smartphones, smart watches, tablet personal computers (PCs), laptop computers, televisions (TVs), and automobile displays, but embodiments are not limited thereto.

A display device 10, which is an example of the loading target element 10, may be manufactured by forming various thin films on a substrate and performing modularization, and an intermediate display device before the modularization or the display device completed through the modularization may be loaded and transported or stored in the tray 1.

Examples of the loading target element 10 may include the display device 10, and such a display device 10 may include a display panel. The display panel may include one or more light sources providing light, and may be, for example, a light receiving panel with external light sources or a self-light emitting panel including internal light emitting elements. The self-light emitting panel may include a plurality of light emitting elements. Each of the light emitting elements may include, for example, an organic light emitting diode, a quantum dot light emitting diode, an inorganic material-based micro light emitting diode (e.g., a micro LED), an inorganic material-based nano light emitting diode (e.g., a nano LED), and the like.

FIGS. 3 and 4 illustrate an example in which the loading target element 10 is a curved display device, and the loading target element 10 may be accommodated in an arc shape in plan view. Specifically, the loading target element 10 may be accommodated in the internal tray 200 in a form in which a connection line connecting both edge areas A of the loading target element 10 to each other forms a curved line having a predetermined curvature in plan view.

When the loading target element 10 is the curved display device, a central area of the loading target element 10 may be supported and guided by the guides 230 in the first column B, and left and right areas of the loading target element 10 excluding the central area of the loading target element 10 may be supported and guided by the guides 230 in the second columns C. Both edge areas A of the loading target element 10 of FIG. 4 may be inserted into the coupling grooves 224 positioned in the pair of tray sidewall portions 220 and may thereby be coupled to the tray sidewall portions 220.

When the loading target element 10 is the display device 10, various types of display devices 10 having a curved, bent, or flat structure may be loaded in the tray 1. In addition, when the loading target element 10 is the display device 10, a small, medium, or large display device 10 may be accommodated in the tray 1.

Referring to FIG. 5, the loading target element 10 may include an element guide contact surface 11, which is a first surface in contact with a guide contact surface 234 (shown in FIG. 7) of the guide 230 of the tray 1, a second surface 12 opposite to the element guide contact surface 11 along the Y direction, and four edge surfaces positioned between the element guide contact surface 11, which is the first surface, and the second surface 12, along the thickness direction. As an example, referring to FIG. 5, when the element guide contact surface 11 of one loading target element 10 is in contact with one guide 230, the second surface 12 opposite to the element guide contact surface 11, which is the first surface, may be in contact with another guide 230 positioned on a contact path P, which is described further below with reference to FIG. 7.

When the loading target element 10 has a rectangular shape, the loading target element 10 may have four edge surfaces around the perimeter of the loading target element 10, and the four edge surfaces may extend along edges of front and back major surfaces 11 and 12 of the loading target element 10. A first edge surface 13 (described further below with reference to FIGS. 10 and 11) is in a lower area of the loading target element 10 and may be in contact with the base surface 211 of the tray bottom portion 210 when the loading target element 10 is accommodated in the internal tray 200. The two edge surfaces in lateral areas of the loading target element 10 may constitute all or part of the edge areas A and may be accommodated in the coupling grooves 224 of the tray sidewall portions 220, and the remaining edge surface, which is in an upper area of the loading target element 10, is a surface opposite to the first edge surface 13 and may face the tray cover 300. Here, the loading target element 10 having four edge surfaces is described as an example, but embodiments of the present disclosure are not limited thereto. In some other embodiments, the loading target element may have a circular shape and only one edge surface, or the loading target element may have a polygonal shape and multiple edge surfaces such as three edge surfaces, four edge surfaces, or five or more edge surfaces.

Figure 7:
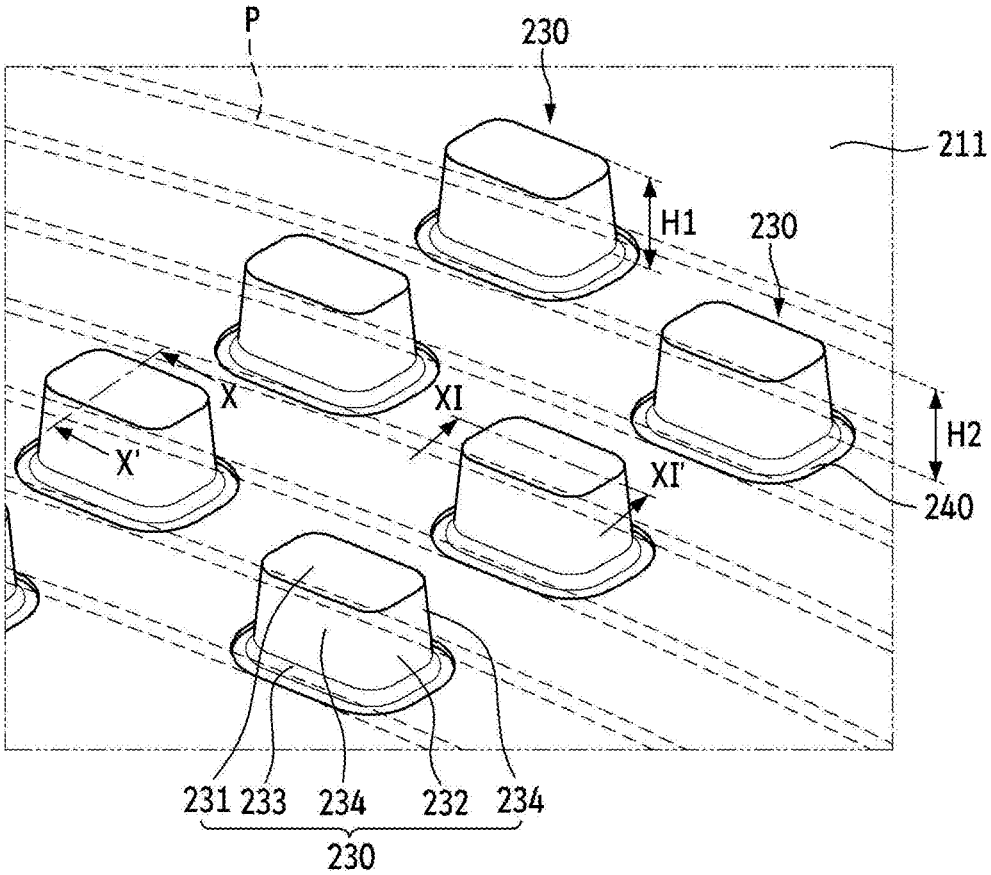
FIG. 7 is a perspective view of guides and avoidance grooves shown in FIG. 5.

Referring to FIGS. 5 and 7, as an example, in the case where the loading target element 10 is a curved automobile module, the loading target element 10 may be accommodated in the vertical direction, and each guide 230 of the internal tray 200 may extend or protrude in the Z direction. In this specific case, the loading target element 10 may be accommodated in the internal tray 200 in a state where the element guide contact surface 11 of the loading target element 10 is in contact with a guide contact surface 234 (described further below) of the guide 230, and the first edge surface 13 of the loading target element 10 is in contact with the base surface 211 of the tray bottom portion 210, except that the avoidance groove 240 prevents a portion of the first edge surface 13 from contacting the base surface 211. Additionally, the first edge surface 13 is not in contact with a guide inclined or transition surface 233 (described further below) of the guide 230 protruding on the base surface 211.

Referring to FIG. 6, the width W3 of the loading target element 10 may be smaller than a width W4 of the avoidance groove 240, but embodiments of the present disclosure are not limited thereto, and the width W3 may instead be the same size as the width W4 of the avoidance groove 240.

Figure 8:
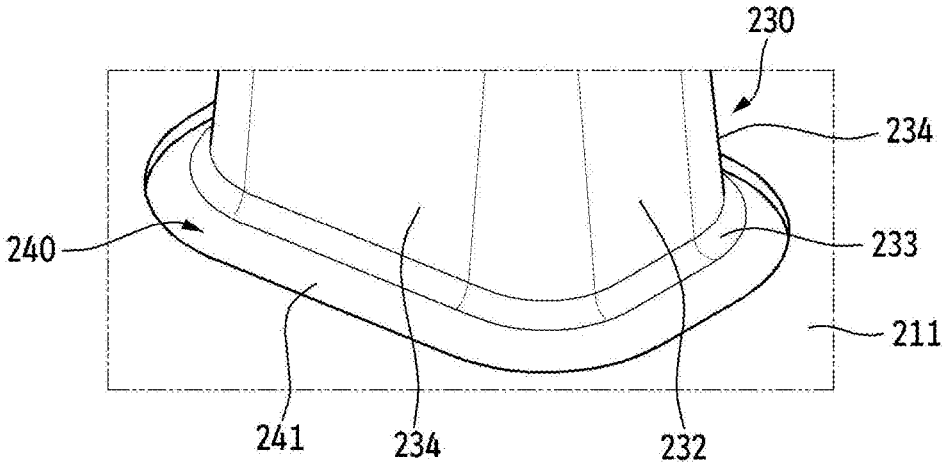
FIG. 8 is an enlarged perspective view of an inclined surface of a guide and an avoidance groove illustrated in FIG. 7.
Figure 9:
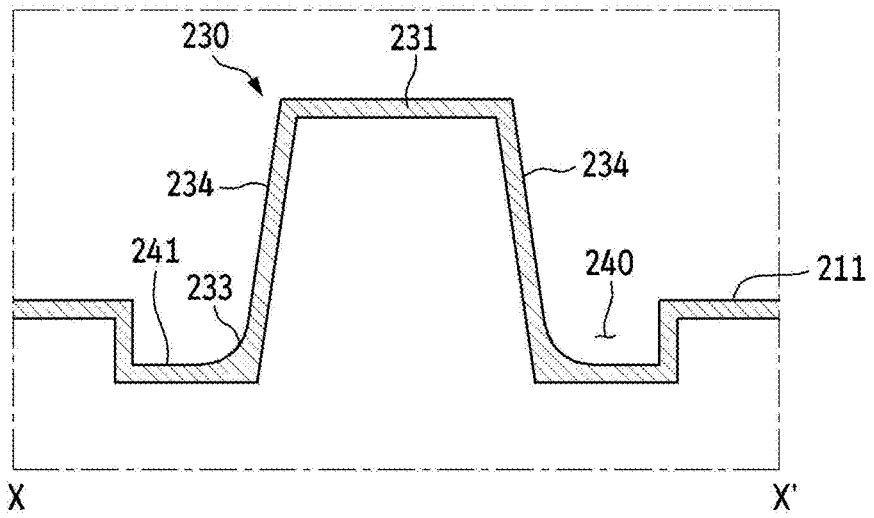
FIG. 9 is a cross-sectional view of the guide of FIG. 7 taken along a section line X-X'.
Figure 10:
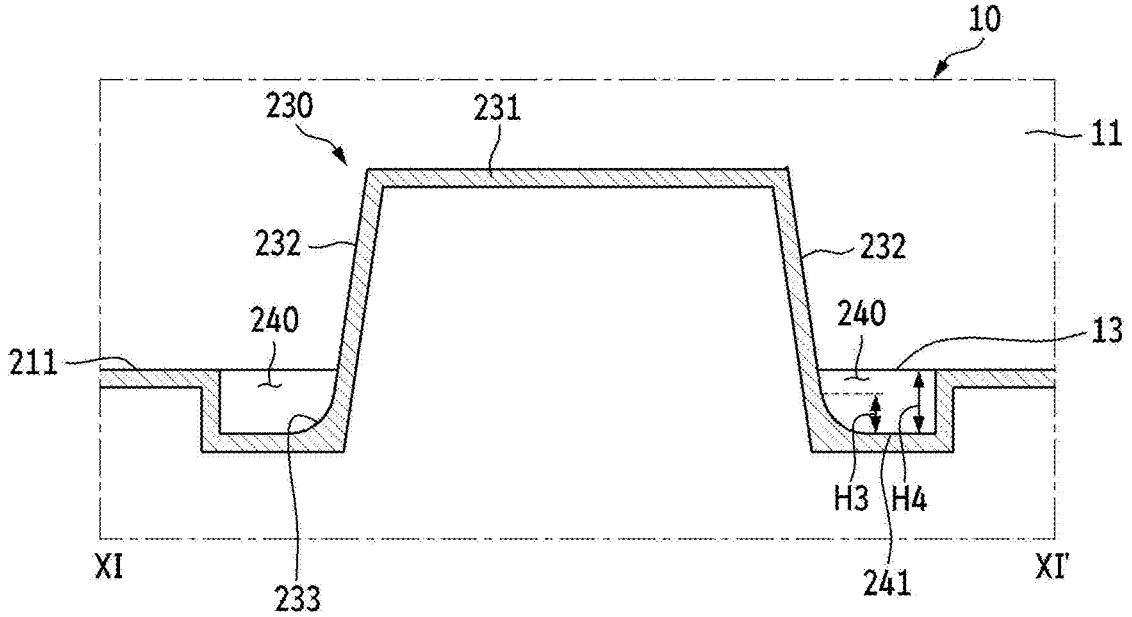
FIG. 10 is a cross-sectional view of the guide of FIG. 7 taken along line XI-XI'.
Figure 11:
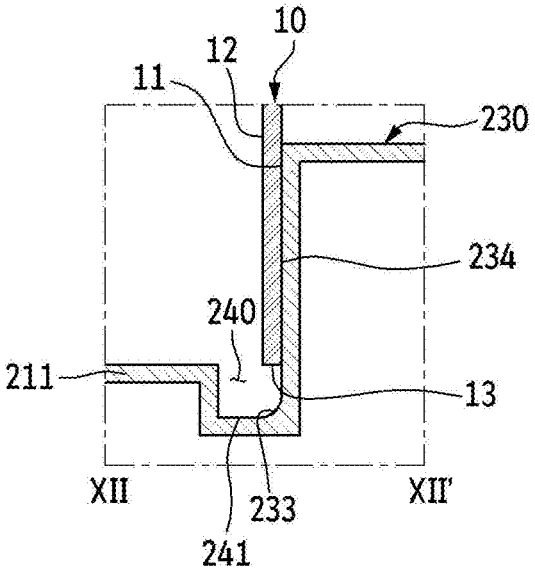
FIG. 11 is a cross-sectional view taken along line XII-XII' of FIG. 6.
Figure 12:
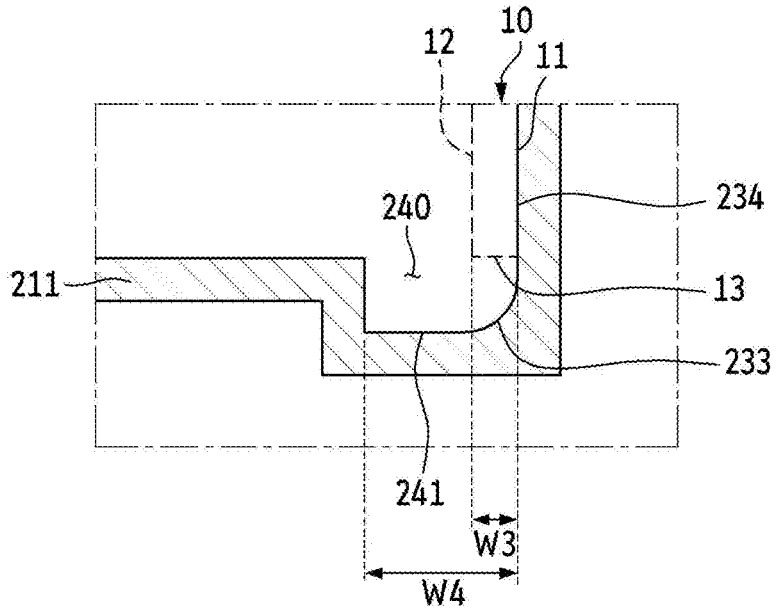
FIG. 12 is an enlarged view of the avoidance groove illustrated in FIG. 11.

FIG. 7 is a perspective view showing a set of the guides 230 and the avoidance grooves 240 of FIG. 5, FIG. 8 is an enlarged perspective view showing an inclined surface of one of the guides 230 and the avoidance groove 240 surrounding the guide 230 as illustrated in FIG. 7, FIG. 9 is a cross-sectional view of one of the guides 230 taken along line X-X' in FIG. 7, FIG. 10 is a cross-sectional view of one of the guides 230 taken along line XI-XI' of FIG. 7, FIG. 11 is a cross-sectional view taken along line XII-XII' of FIG. 6, and FIG. 12 is an enlarged view of the avoidance groove 240 illustrated in FIG. 11.

Referring to FIG. 7, each guide 230 may include a guide upper surface 231 facing the tray cover 300, a pair of guide contact surfaces 234 in contact with the element guide contact surfaces 11 or 12 of the loading target elements 10, a pair of guide side surfaces 232 not in contact with any loading target elements 10, and the guide inclined surface 233 positioned in a lower area of the guide 230.

The guides 230 may be disposed at intervals along the contact paths P of the loading target elements 10 in contact with the base surface 211, and specifically, the guide contact surfaces 234 may be positioned along the contact paths P on which the loading target elements 10 contact the base surface 211.

Heights of the plurality of guides 230 may be the same as each other, may be different from each other, or may be different from each other for each arrangement. For example, the height of the guides 230 in the first column B of FIG. 3 may be greater or smaller than or the same as the height of the guides 230 in the second columns C. When the height of each guide 230 in the first column B is greater than the height of each guide 230 in the second columns C, the guides 230 may stably support the loading target element 10 at the center of the loading target element 10 to suppress the movement of the loading target element 10 that external shock might otherwise cause.

Referring to FIG. 7, as an example, a height H1 of one guide 230 from the base surface 211 to the guide upper surface 231 may be the same as a height H2 of an adjacent guide 230, but embodiments of the present disclosure are not limited thereto, and the heights H1 and H2 may also be different from each other. When the heights H1 and H2 are the same as each other, the guides 230 may be formed at the same heights H1 and H2 using a single mold, and thus, cost and time for manufacturing the internal tray 200 may be reduced.

Each guide 230 may have a protrusion shape which protrudes from the base surface 211 in an upward direction, which is the Z direction, and the protrusion shape may be a hexahedron including a quadrangular surface, but embodiments are not limited thereto.

Each guide 230 may have a trapezoidal cross-sectional shape as illustrated in FIGS. 9 and 10, but the cross-sectional shape is not limited thereto and may, for example, be triangular, square, circular, or elliptical.

Referring to FIGS. 7 and 8, the avoidance groove 240 may have a closed loop shape in plan view and may serve to prevent a portion of the first edge surface 13 at a lower surface of the loading target element 10 from being in contact with the guide inclined surface 233 of the guide 230.

Referring to FIGS. 8 and 9, the avoidance groove 240 may include a groove bottom surface 241 recessed from the base surface 211 and positioned to be stepped with respect to the base surface 211. The groove bottom surface 241 may be parallel to the base surface 211 on a different plane from the base surface 211, may be positioned at a lower level than the base surface 211 by a height H4 illustrated in FIG. 10, and may be connected to the guide inclined surface 233 and connected to the base surface 211.

Referring to FIGS. 10 and 11, the avoidance groove 240 may include the groove bottom surface 241 connected to the guide inclined surface 233, and a height H3 from the groove bottom surface 241 of the avoidance groove 240 to a top of the guide inclined surface 233 (e.g., to the bottom of the guide side surface 232) may be smaller than the height H4 from the groove bottom surface 241 to the base surface 211. Here, when the first edge surface 13 of the loading target element 10 is in contact with the base surface 211 as illustrated in FIG. 10, the height H4 from the groove bottom surface 241 to the base surface 211 may be a height H4 from the groove bottom surface 241 to the first edge surface 13 of the loading target element 10.

Since the height H3 from the groove bottom surface 241 of the avoidance groove 240 to the top of the guide inclined surface 233 is smaller than the height H4 from the groove bottom surface 241 to the first edge surface 13 of the loading target element 10 as described above, even though the loading target element 10 is seated on the base surface 211 and the first edge surface 13 of the loading target element 10 is in contact with the base surface 211, the first edge surface 13 of the loading target element 10 is not in contact with the guide inclined surface 233 of the guide 230 as illustrated in FIG. 11, and thus, a phenomenon in which the guide inclined surface 233 rubs on the first edge surface 13 of the loading target element 10 may be prevented.

FIG. 10 illustrates an example in which the height H3 of inclined surface 233 in the avoidance groove 240 is smaller than the height H4 from the groove bottom surface 241 to the base surface 211, but the present disclosure is not limited thereto, and the height H3 in FIG. 10 may be variously configured as long as the first edge surface 13 of the loading target element 10 when seated on the base surface 211 is not in contact with the guide inclined surface 233. For example, the height H3 in FIG. 10 in the avoidance groove 240 may also be the same as the height H4 from the groove bottom surface 241 to the base surface 211.

Referring to FIGS. 6 and 12, the width W4 of the avoidance groove 240 may be greater than the width W3 of the loading target element 10. Here, the first edge surface 13 of the loading target element 10 may be in contact with the base surface 211 along the contact path P and may not be in contact with the base surface 211 in an area where the guide inclined surface 233 of the guide 230 is positioned. When the width W4 of the avoidance groove 240 is greater than the width W3 of the loading target element 10, a surface contact of the loading target element 10 on the guide inclined surface 233 of the guide 230 is eliminated, such that a load or weight of the loading target element 10 is not concentrated on a small area of the first edge surface 13 of the loading target element 10. In addition, when the width W4 of the avoidance groove 240 is greater than the width of the loading target element 10, the first edge surface 13 of the loading target element 10 may certainly avoid the guide inclined surface 233, such that a phenomenon in which the first edge surface 13 of the loading target element 10 is rubbed, that is, damaged by the guide inclined surface 233 may be prevented. Meanwhile, the width W4 of the avoidance groove 240 may also be the same as or smaller than the width W3 of the loading target element 10 as long as the loading target element 10 does not contact the guide inclined surface 233.

When the loading target element 10 is accommodated in the tray 1 having such a configuration, the element guide contact surface 11 of the loading target element 10 is in contact with the guide contact surface 234 of the guide 230 and the first edge surface 13 of the loading target element 10 is in contact with the base surface 211, and accordingly, the loading target element 10 is loaded in the stand-up direction with respect to the tray bottom portion 210. In this case, the avoidance groove 240 recessed from the base surface 211 avoids contact between the first edge surface 13 of the loading target element 10 and the guide inclined surface 233 so that the first edge surface 13 of the loading target element 10 is not in contact with the guide inclined surface 233, and accordingly, a rubbing phenomenon in which the first edge surface 13 of the loading target element 10 is rubbed by the guide inclined surface 233 may be prevented. That is, damage to the loading target element 10 may be prevented.

Figure 13:
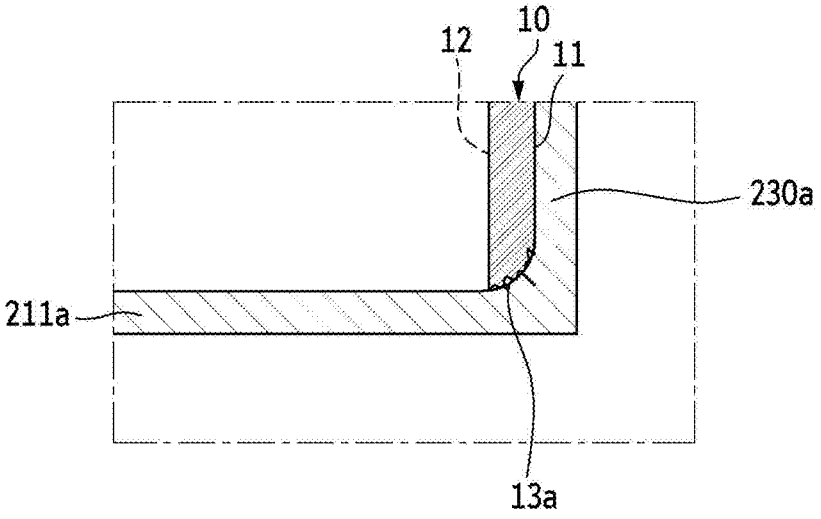
FIG. 13 is a cross-sectional view illustrating a loading target element in contact with the guide without the avoidance groove, unlike FIG. 12.

FIG. 13 is a cross-sectional view illustrating a comparative embodiment in which a loading target element 10 is in contact with a guide 230*a* without the avoidance groove described above. Unlike the embodiment of FIG. 12 in which each guide 230 has an adjacent avoidance groove 240, the guide 230*a* in the comparative embodiment of FIG. 13 protrudes from a base surface 211*a* and does not have an avoidance groove 240. As a result, a first edge surface 13*a* of the loading target element 10 is in direct contact with a lower area of the guide 230*a*, and particularly directly contacts an incline or transition area of the guide 230*a* and the base surface 211*a*. This contact may cause a rubbing phenomenon to occur and damage the first edge surface 13*a*.

Hereinafter, other exemplary embodiments will be described with reference to FIGS. 14 to 18.

Figure 14:
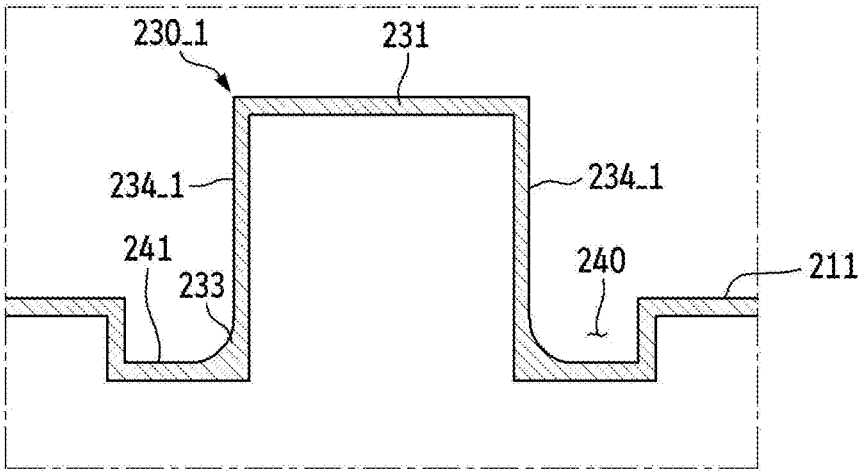
FIG. 14 is a cross-sectional view of a guide according to another exemplary embodiment.

FIG. 14 is a cross-sectional view of a guide according to another exemplary embodiment. FIG. 14 shows an embodiment differs from the exemplary embodiment of FIG. 9 in a shape of a guide. In FIG. 9, the guide 230 may have the trapezoidal cross-sectional shape, while FIG. 14 shows a guide 230_1 having a square cross-sectional shape according to a cross section. However, the present disclosure is not limited thereto, and the guide 230_1 may have various cross-sectional shapes such as a quadrangular shape or a circular shape. When the guide 230_1 is square shaped, the guide 230_1 may more stably support the loading target element 10. Here, the guide 230_1 may include a guide upper surface 231 and guide contact surfaces 234_1.

Figure 15:
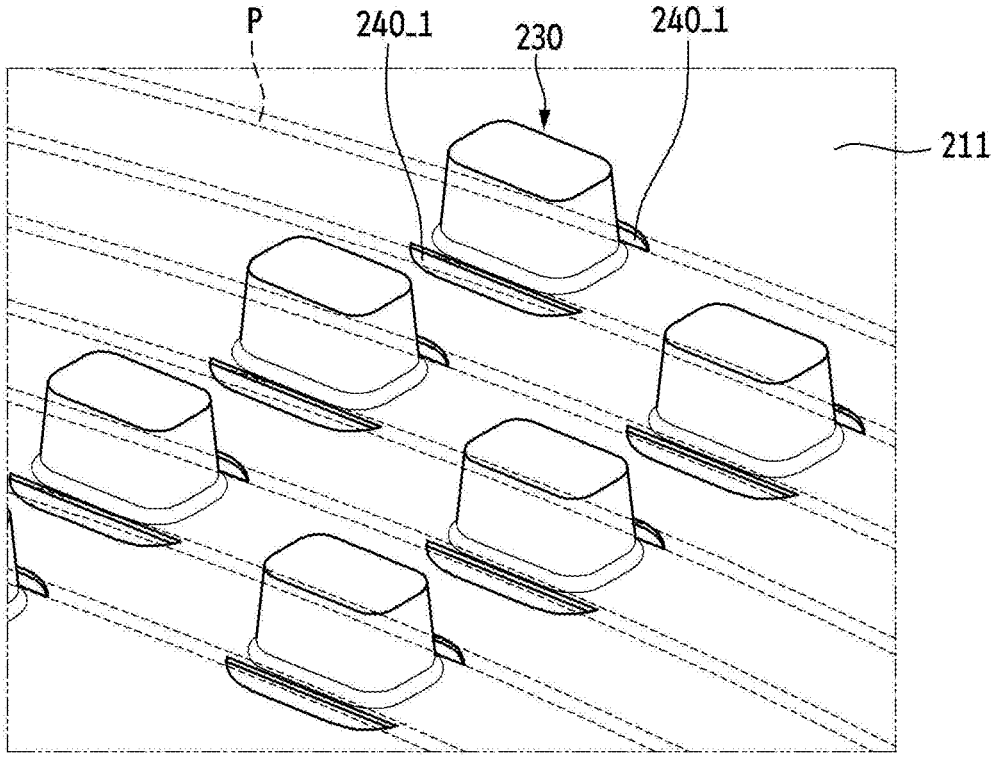
FIGS. 15, 16, 17, and 18 show trays according to other exemplary embodiments.

FIG. 15 is an enlarged perspective view of a guide and an avoidance groove according to still another exemplary embodiment. FIG. 15 shows an exemplary embodiment that may be the same as the exemplary embodiment of FIG. 7 except for avoidance grooves 240_1 formed around the guides 230. Referring to FIG. 15, a pair of avoidance grooves 240_1 may only be included along the long sides of the guides 230. The avoidance groove 240 may have a continuously connected closed loop shape as illustrated in FIG. 7, but a pair of avoidance grooves 240_1 may be discontinuously positioned in the long side direction of each guide 230 shown in FIG. 15. Due to avoidance grooves 240_1 positioned on the path P along which the loading target element 10 passes, the loading target element 10 is not in contact with the guide inclined surface 233, and accordingly, a rubbing phenomenon of the loading target element 10 may be prevented.

Figure 16:
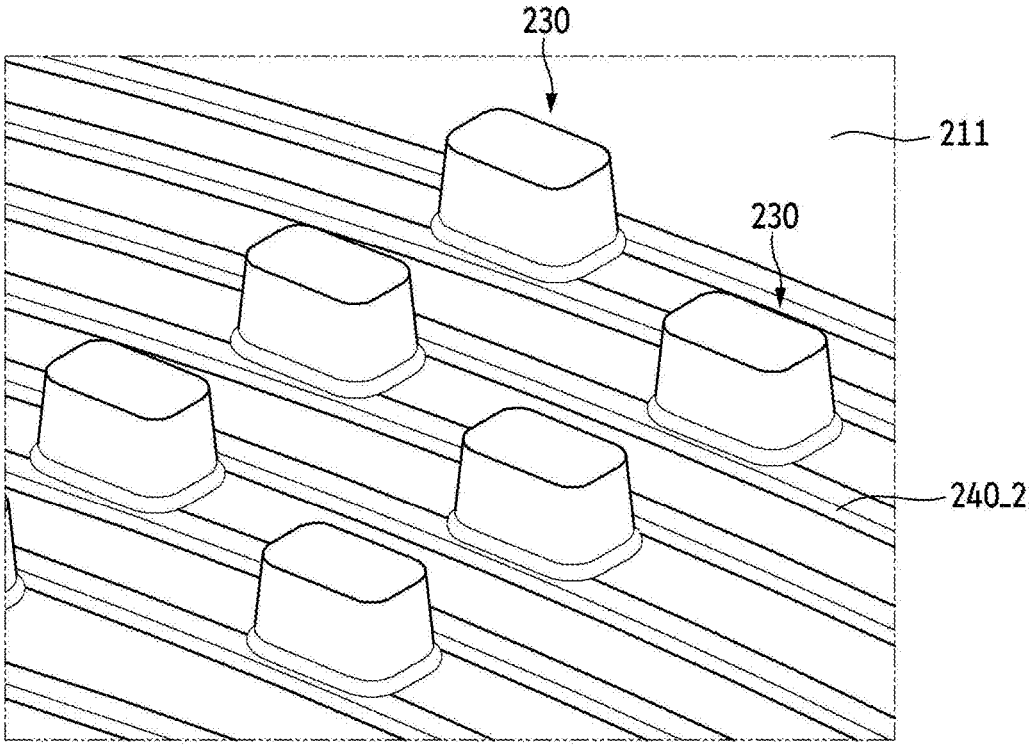

FIG. 16 illustrates a tray according to still another exemplary embodiment. The embodiment of FIG. 16 differs from the embodiment of FIG. 3 in that avoidance grooves 240_2 shown in FIG. 16 are elongated along the contact path P of the loading target element 10. The avoidance grooves 240_2 may be narrower than the width of the loading target element 10, so that the loading target element 10 contacts the base surface 211, and the avoidance grooves may 240_2 may be deep enough to prevent the loading target element 10 from contacting inclined or transition surfaces of the guides 230. Accordingly, a rubbing phenomenon of the loading target element 10 may be prevented.

Figure 17:
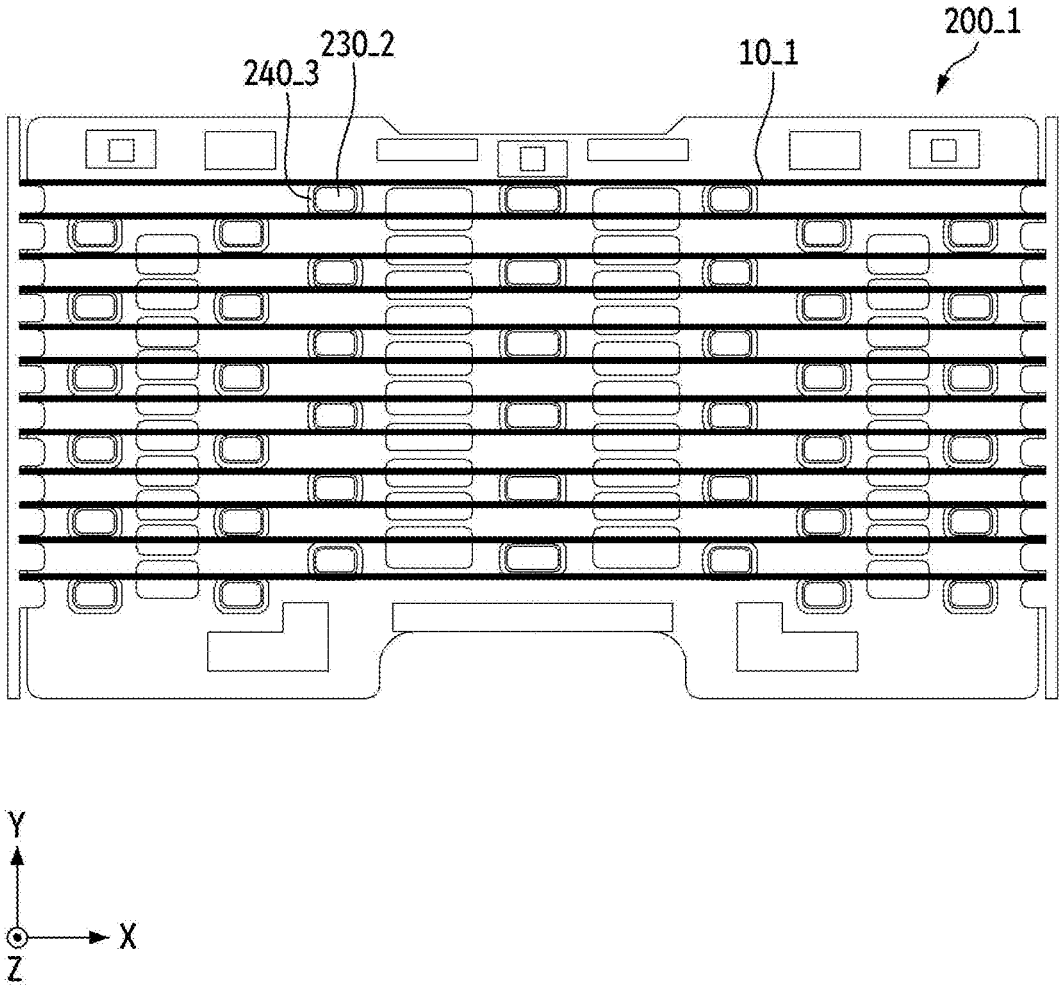

FIG. 17 is a plan view illustrating an embodiment where flat loading target elements are accommodated in a tray. A tray 200_1 of FIG. 17 may be the same as the embodiment shown in FIG. 4 except that loading target elements 10_1 are straight or flat, and guides 230_2 and avoidance grooves 240_3 are arranged in an internal tray 200_1 to accommodate the flat loading target elements 10_1. That is, referring to FIG. 17, the guides 230_2 may be arranged in a straight line direction along the X direction. More generally, the guides 230_2 may be variously arranged according to the shape of the loading target element 10_1 loaded in the tray 1.

Figure 18:
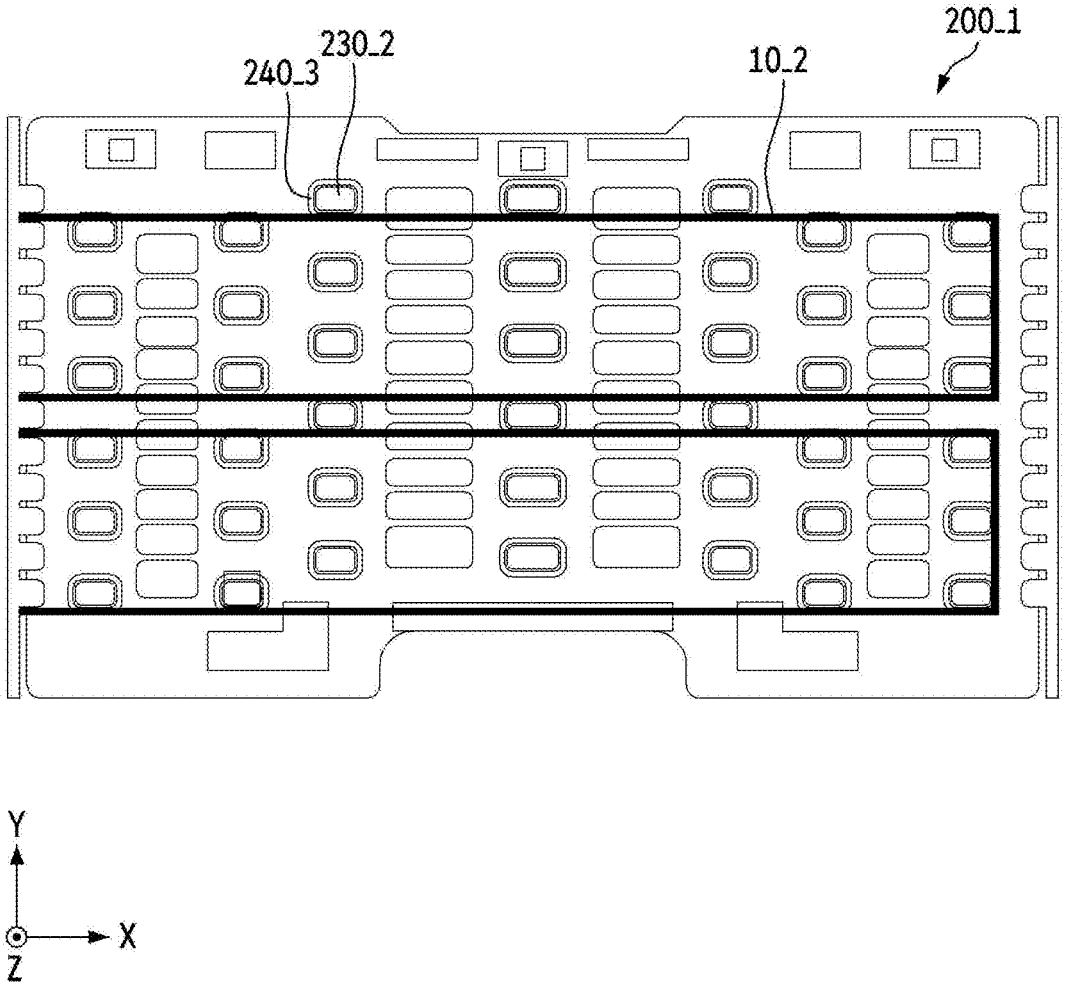

FIG. 18 is a plan view illustrating accommodation of loading target elements in a tray according to still another exemplary embodiment. FIG. 18 shows an exemplary embodiment that may be the same as the embodiment of FIG. 17 except that bent loading target elements 10_2 are accommodated in the internal tray 200_1.

Referring to FIG. 18, loading target element 10_2 may be bendable loading target elements 10_2, which may be accommodated in the internal tray 200_1 so as to be bent at the locations of some of the guides 230_2. Here, the loading target element 10_2 may be a vehicle module. In particular, a large-area product for an automobile may be vertically loaded for space efficiency. Accordingly, when the large-area product for an automobile is vertically loaded in the internal tray 200_1 in which the avoidance grooves 240_3 are formed as illustrated in FIG. 18, the avoidance grooves 240_3 around the guides 230_2 can prevent of a rubbing phenomenon between the large-area product for an automobile and the guide 230_2.

The loading target elements 10, 10_1, and 10_2 as described above may be applied to a large display device as well as small and medium display devices, and display devices having a curved structure, a bent structure, or a flat structure may all be loaded in the tray 1.

As described above, with the tray 1 according to an exemplary embodiment, the avoidance grooves 240, 240_1, 240_2, or 240_3 can prevent the loading target element 10, 10_1, or 10_2 from contacting the guide inclined or transition surfaces 233, and thus, the rubbing phenomenon in which the tray 1 rubs or damages the loading target element 10 may be prevented.

The effects of the present disclosure are not restricted to the ones set forth herein. The above and other effects of the present disclosure will become more apparent to one of ordinary skill in the art to which the present disclosure pertains by referencing the claims.

One of ordinary skill in the art to which the present disclosure belongs will understand that the present disclosure may be implemented in other specific forms without changing the technical spirit or essential features of the present disclosure. Therefore, the exemplary embodiments described above are illustrative rather than being restrictive, and the scope of the present disclosure is defined by the claims rather than the detailed description described above and all modifications and alterations derived from the claims and their equivalents fall within the scope of the present disclosure.

What is claimed is:

1. A tray comprising:

a tray bottom portion including a base surface, a guide protruding from the base surface, and an avoidance groove recessed from the base surface; and a tray sidewall portion disposed on at least one edge of the tray bottom portion, wherein at least a portion of the avoidance groove is between the guide and the base surface, wherein the tray bottom portion is configured to accommodate a loading target element that is loaded on the base surface of the tray bottom portion, and the guide is configured so that a side surface of the guide supports the loading target element loaded on the tray bottom portion, wherein the guide includes:

a guide side surface configured to contact a major surface of the loading target element to support the loading target element; and a guide inclined surface extending between the guide side surface and the avoidance groove, wherein a height from a groove bottom surface of the avoidance groove to the base surface is greater than a height of the guide inclined surface from the groove bottom surface of the avoidance groove to the guide side surface.

2. The tray of claim 1, wherein a sidewall of the avoidance groove is aligned with a side surface of the guide adjacent to the avoidance groove.

3. The tray of claim 1, wherein the avoidance groove is in direct contact with the guide and the base surface.

4. The tray of claim 1, wherein a width of the avoidance groove is greater than a width of the loading target element.

5. The tray of claim 1, wherein the loading target element is a curved, bent, or flat display device.

6. The tray of claim 1, wherein the tray sidewall portion includes a coupling portion configured to couple an edge area of the loading target element to the tray sidewall portion.

7. The tray of claim 6, wherein the coupling portion includes:

a plurality of coupling protrusions positioned on the tray sidewall portion and disposed at intervals; and a coupling groove formed between the plurality of coupling protrusions and accommodating the edge area of the loading target element.

8. The tray of claim 7, wherein a width of the coupling groove is greater than a width of the edge area of the loading target element accommodated in the coupling groove.

9. The tray of claim 1, wherein the guide is one of a plurality of guides, and the plurality of guides are arranged at intervals along a contact path on which the loading target element contacts the base surface.

10. The tray of claim 9, wherein the avoidance groove extends continuously along the contact path.

11. The tray of claim 9, wherein a connection line connecting the plurality of guides to each other forms a curved line.

12. The tray of claim 9, wherein a connection line connecting the plurality of guides to each other forms a straight line.

13. The tray of claim 1, wherein the guide has a cross-sectional shape selected from a group consisting of triangular, quadrangular, circular, and elliptical.

14. The tray of claim 1, wherein the avoidance groove has a closed loop shape that extends around a perimeter of the guide.

15. The tray of claim 1, wherein the avoidance groove is discontinuously formed along a perimeter of the guide.

16. The tray of claim 1, further comprising a bottom tray supporting the tray bottom portion and the tray sidewall portion below the tray bottom portion and the tray sidewall portion and a tray cover covering the tray bottom portion and the tray sidewall portion above the tray bottom portion and the tray sidewall portion.

17. The tray of claim 1, further comprising:

a tray body accommodating a plurality of loading target elements in a stand-up direction, the plurality of loading target elements comprising the loading target element, wherein the tray body includes the base surface contacting lower edges of the loading target elements, a plurality of guides protruding from the base surface and supporting the loading target elements in the stand-up direction, the plurality of guides comprising the guide, and avoidance grooves recessed from the base surface in areas adjacent to the guides, the avoidance grooves comprising the avoidance groove, wherein a connection line connecting both side edges of one of the loading target elements accommodated in the tray body is a curved line.

18. The tray of claim 17, wherein a width of each of the avoidance grooves is greater than a width of each of the loading target elements.

* * * * *